US006350145B1

(12) United States Patent
Chen et al.

(10) Patent No.: US 6,350,145 B1
(45) Date of Patent: Feb. 26, 2002

(54) FLEXIBLE PRINTED CIRCUIT BOARD CRIMP TERMINAL AND CRIMPING STRUCTURE FOR CORE THEREWITH

(75) Inventors: Ping Chen, Mundelein, IL (US); Takashi Iida, Anjo (JP)

(73) Assignee: Japan Solderless Terminal Mfg. Co., Ltd., Osaka-fu (JP)

( * ) Notice: Subject to any disclaimer, the term of this patent is extended or adjusted under 35 U.S.C. 154(b) by 0 days.

(21) Appl. No.: 09/477,670

(22) Filed: Jan. 5, 2000

(30) Foreign Application Priority Data

Mar. 11, 1999 (JP) ..... 11-065694

(51) Int. Cl.[7] ..... H01R 4/24; H01R 4/26; H01R 11/20; H01R 4/10

(52) U.S. Cl. ..... 439/422; 439/877

(58) Field of Search ..... 439/877, 865, 439/878, 879, 422, 421, 423, 492, 493; 174/840

(56) References Cited

U.S. PATENT DOCUMENTS 3,715,457 A 2/1973 Teagno et al.
3,728,473 A 4/1973 Kuo
5,772,454 A * 6/1998 Long, Jr. ..... 439/83

FOREIGN PATENT DOCUMENTS

| | | |
|---|---|---|
| CH | 353422 | 4/1961 |
| GB | 2 244 871 A | 12/1991 |
| JP | 4-223069 | 8/1992 |

* cited by examiner

*Primary Examiner*—Brian Sircus
*Assistant Examiner*—Chandrika Prasad
(74) *Attorney, Agent, or Firm*—Nixon Peabody LLP; Donald R. Studebaker

(57) ABSTRACT

An FPC crimp terminal comprising a bottom plate being formed from a flat plate and a fixing part rising from an edge of the bottom plate, said FPC crimp terminal being formed in such a way that when a core or a lead wire is brought into direct contact with a conductor of an FPC, the fixing part is made to pierce the FPC from its back or front and the top end of the fixing part coming out of the FPC is bent towards the bottom plate, the core or the lead wire and the FPC will be pinched between the top end of the fixing part and the bottom plate. As the fixing part is used to effect the piercing process and the connecting process at the same time, the FPC crimp terminal can be compactified and the work efficiency can be enhanced through reduction in the number of processes.

16 Claims, 9 Drawing Sheets

FLEXIBLE PRINTED CIRCUIT BOARD CRIMP TERMINAL AND CRIMPING STRUCTURE FOR CORE THEREWITH

BACKGROUND OF THE INVENTION

1. Field of the Invention

The present invention relates to improvements on a flexible printed circuit board crimp terminal for connecting a core of an electric wire or a lead wire of an electrical component to a flexible printed circuit board (hereinafter referred to as FPC) having good flexibility.

2. Related Art

An FPC crimp terminal for connecting a terminal or the like of a counterpart to an FPC has been known, as shown in FIG. 8, wherein a rectangular bottom plate 91, pointed fixing parts 92, 92, 92 rising from both edges in the width direction of the bottom plate 91 at one end thereof, and a connecting or splicing part 93 formed at the other end of the bottom plate 91 and to be connected to a terminal or the like of the counterpart are provided, and the above-mentioned fixing parts 92, 92, 92 are forced to pierce the FPC from its back, then the fixing parts 92, 92, 92 coming out of the front of the FPC are bent towards the bottom plate 91 (this operation is called piercing), and finally, the connecting part 93 is connected to a terminal or the like of the counterpart (for example, refer to Japanese Provisional Patent Hei 4-223069).

In the above-mentioned conventional FPC crimp terminal, as fixing parts 92 are formed on one end of the bottom plate 91 and the connecting part 93 are formed on the other end thereof, the bottom plate 91 has to be long thus a greater space is required. This prevents compactification of a connector or the like in which this FPC crimp terminal is used. There is another drawback. It is low efficiency of work since this FPC crimp terminal requires two processes; the piercing process to pierce the fixing parts 92 through the FPC and bend them, and the connecting process to connect the connecting part 93 to a terminal or the like of the counterpart.

SUMMARY OF THE INVENTION

The present invention was made in view of these points, and its objective is to provide an FPC crimp terminal for connecting a core of an electric wire or a lead wire of an electric component to an FPC and use the fixing part to accomplish the piercing process and the connecting process simultaneously so as to compactify the FPC crimp terminal and improve the work efficiency through reduction in the total number of processes.

To accomplish the above-mentioned objective, the FPC crimp terminal disclosed herein is provided with a bottom plate being formed from a flat plate and a fixing part rising from an edge of the bottom plate, and this FPC crimp terminal is formed in such a way that when a core or a lead wire is brought into direct contact with a conductor of an FPC, the fixing part is made to pierce the FPC from its back or front and the top end of the fixing part coming out of the FPC is bent towards the bottom plate, the core or the lead wire and the FPC will be pinched between the top end of the fixing part and the bottom plate.

When a core or a lead wire is brought into direct contact with a conductor of an FPC, the fixing part of the above-mentioned FPC crimp terminal is made to pierce the FPC, and the top end of the fixing part coming out of the FPC is bent towards the bottom plate, the core or the lead wire and the FPC will be pinched between the top end of the fixing part and the bottom plate and the core or the lead wire will be connected to the FPC. In this case, as piercing with the fixing part also effects connecting the core or the lead wire, there is no need of, unlike the conventional case, providing a connecting or splicing part separately. Accordingly, the terminal can be made shorter and more compact by that portion, and a connector or the like that uses this terminal can be compactified significantly. Furthermore, as the piercing process and the connecting process are made simultaneously, the number of processes is reduced and the work efficiency of connecting the core or the lead wire to the FPC is enhanced.

The next FPC crimp terminal disclosed herein is provided with a bottom plate being a rectangular flat plate and fixing parts rising from both edges in the width direction of the bottom plate, and this FPC crimp terminal is formed in such a way that when a core or a lead wire is brought into direct contact with a conductor of an FPC, the fixing parts rising from both edges in the width direction of the bottom plate are made to straddle the core or the lead wire and pierce the FPC from its back or front, and the top ends of the fixing parts coming out of the FPC are bent towards the bottom plate, the core or the lead wire and FPC will be pinched between the top ends of the fixing parts and the bottom plate.

When a core or a lead wire is brought into direct contact with a conductor of an FPC, the fixing parts rising from both edges in the width direction of the bottom plate of the above-mentioned FPC crimp terminal are made to straddle the core or the lead wire and pierce the FPC, and the top ends of the fixing parts coming out of the FPC are bent towards the bottom plate, the core or the lead wire and the FPC will be pinched between the top ends of the fixing parts and the bottom part and the core or the lead wire will be connected to the FPC. In this case, as piercing with the fixing parts also effects connecting the core or the lead wire, there is no need of, unlike the conventional case, providing a connecting or splicing part separately. Accordingly, the terminal can be made shorter and more compact by that portion, and a connector or the like that uses this FPC crimp terminal can be compactified significantly. Furthermore, as the piercing process and the connecting process are made simultaneously, the number of processes is reduced and the work efficiency of connecting the core or the lead wire to the FPC is enhanced. Moreover, as at least a pair of fixing parts rise from both edges in the width direction of the bottom plate, the pinching forces of the fixing parts are stable and the resulting crimping forces on the core or the lead wire are balanced well.

More FPC crimp terminals are disclosed herein that are the respective above-mentioned FPC crimp terminals with a stopper being formed on one end in the longitudinal direction of the bottom plate to protrude in the direction of withdrawal of the core or the lead wire.

With this arrangement, when an FPC crimp terminal with a core or a lead wire connected is stored in a casing or the like of a connector, even if the core or the lead wire is pulled in the direction of withdrawal, the stopper will be held by the casing or the like and the FPC crimp terminal will be hardly withdrawn from the casing or the like, preventing defective connection.

Further, a crimp structure is disclosed herein that uses the respective above-mentioned FPC crimp terminals to connect a core to an FPC. In this crimp structures, a core is brought into direct contact with a conductor of an FPC, a fixing part or fixing parts is made to pierce the FPC from its back or front, the top end of the fixing part or the top ends of the fixing parts coming out of the FPC is bent towards the bottom plate, the core and the FPC are pinched between the top end of the fixing part or the top ends of the fixing parts and the bottom plate, and the fixing part or the fixing parts crimps the core with the top end of the core left uncrimped.

In this crimp structure, in addition to the functions and effects of the respective above-mentioned FPC crimp terminals, a difference in grade that is formed on the core between the portion crimped by the fixing part and the top portion not crimped secures sufficient retention force for the core and the core will be hardly withdrawn.

PREFERRED EMBODIMENTS OF THE INVENTION

Figure 1:
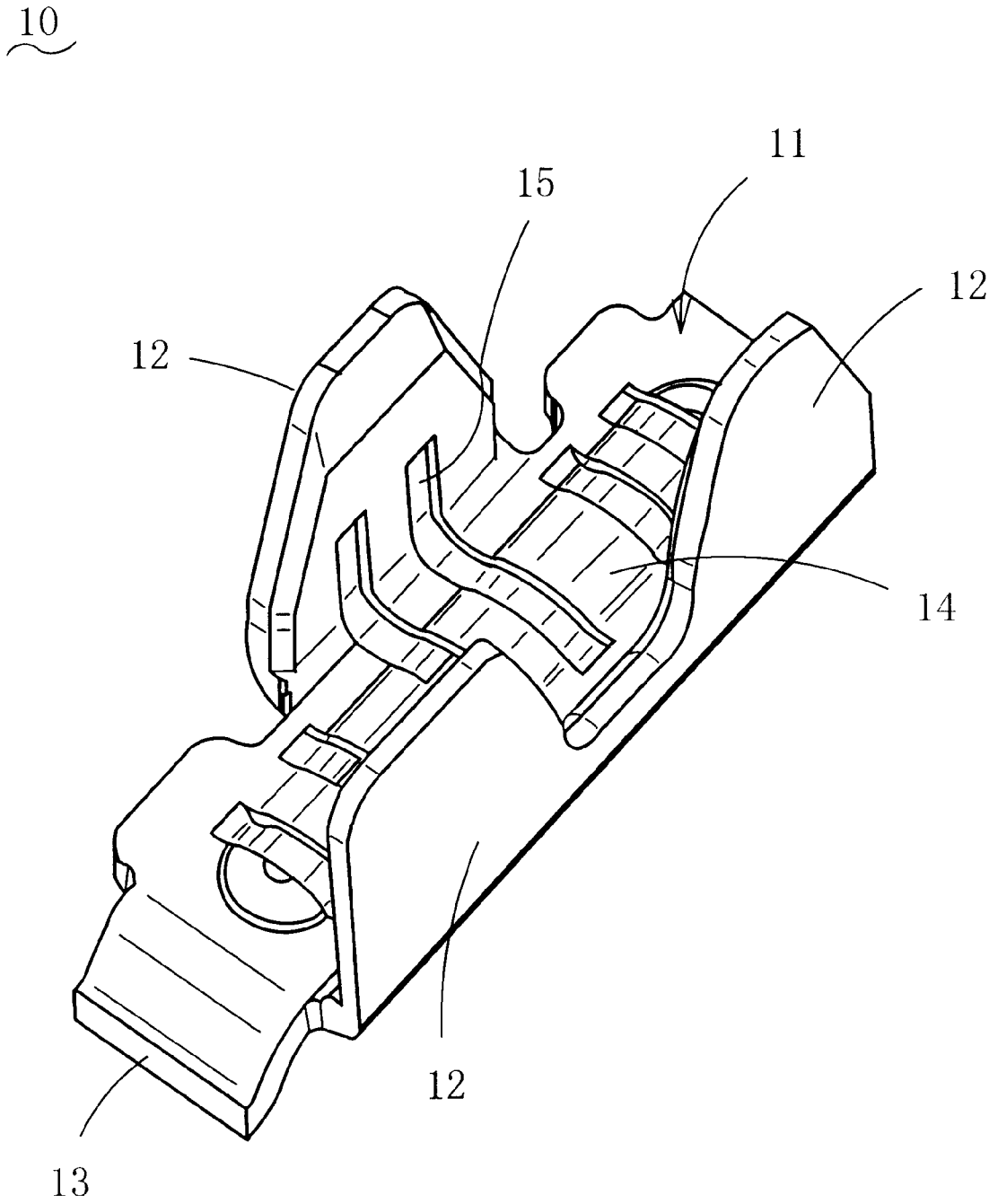
FIG. 1 is a perspective view of the first embodiment of the FPC crimp terminal according to the present invention.

In the following, embodiments of the present invention will be described with reference to the drawings. FIG. 1 shows an FPC crimp terminal 10 of the first embodiment. This FPC crimp terminal 10 is exemplified by a form shown in FIG. 2 and this form is used when the terminal is used to connect a core 41 of an electric wire 40 or a lead wire 51 of an electric component 50 such as a capacitor to an FPC 30 in a casing 20 of a connector. In this context, an FPC is a highly flexible thin plate or film 31 of resin, etc. on which conductors 32 are fixed. Conductors 32 are exposed at least on one of the faces of the thin plate or film 31. In this case, the front of the FPC 30 is the face on which the conductors 32 are exposed, and the other face is the back. In the exemplifying FPC 30 of the present embodiment, the conductors 32 are arranged to be substantially parallel to each other.

The above-mentioned FPC crimp terminal 10 is provided with a rectangular bottom plate 11 formed from a flat plate and fixing parts 12, 12, 12 rising from both edges in the width direction of the bottom plate 11. This bottom plate 11 is formed into a W-shaped form in section, but it is not necessarily so and the configuration is arbitrary. The fixing parts 12 are, for example, tapered so that they can easily pierce the FPC 30, but it is not necessarily so and the configuration is arbitrary. In this context, taper is exemplified by a form of which width is narrowing towards its top end, a form of which thickness is reduced towards its top end, and a form of combination of the preceding two forms.

The above-mentioned FPC crimp terminal 10 is formed in such a way that when a core 41 or a lead wire 51 is brought into direct contact with a conductor 32 of an FPC 30, fixing parts 12, 12, 12 rising from both edges in the width direction of the bottom plate are made to pierce the FPC 30 from its back or front so that the fixing parts 12, 12, 12 straddle the core 41 or the lead wire 51, the top ends of fixing parts 12, 12, 12 coming out of the FPC 30 are bent towards the bottom plate 11, the core 41 or the lead wire 51 will be pinched between the top ends of the fixing parts 12 and the bottom plate 11. The bottom plate 11 has a width that is substantially identical to the outside diameter of the core 41 or the lead wire 51. Moreover, the height of the fixing part 12 from the bottom plate 11 is set greater than at least the sum of the thickness of the FPC 30 and the outside diameter of the core 41 or the lead wire 51. If the height of the fixing part 12 from the bottom plate 11 is raised more, the core 41 or the lead wire 51 can be pinched more reliably against the FPC 30 with a higher surface pressure, and this is preferable.

The above-mentioned FPC crimp terminal 10 has the bottom plate 11 that is provided with a stopper 13, and the stopper 13 is formed on one end in the longitudinal direction of the bottom plate 11 to protrude in the withdrawal direction of the core 41 or the lead wire 51. This stopper 13 is formed, when necessary, to slant a little in the direction opposite to the direction the fixing parts 12 rise from the bottom plate 11. 14 denotes a dimple for reinforcement that is formed, when necessary, by lifting a central part of the bottom plate 11. 15 denotes a bead for reinforcement that is formed, when necessary, by concaving the upper face of the bottom plate 11.

The above-mentioned FPC crimp terminal 10 is formed from a single plate. For example, it is formed by blanking out a blank from a plate and bending fixing parts 12, 12, 12 in relation to the bottom plate 11. In this sequence of processes, when necessary, a dimple 14 and beads 15 are formed and the stopper 13 is bent in relation to the bottom plate 11.

Figure 3:
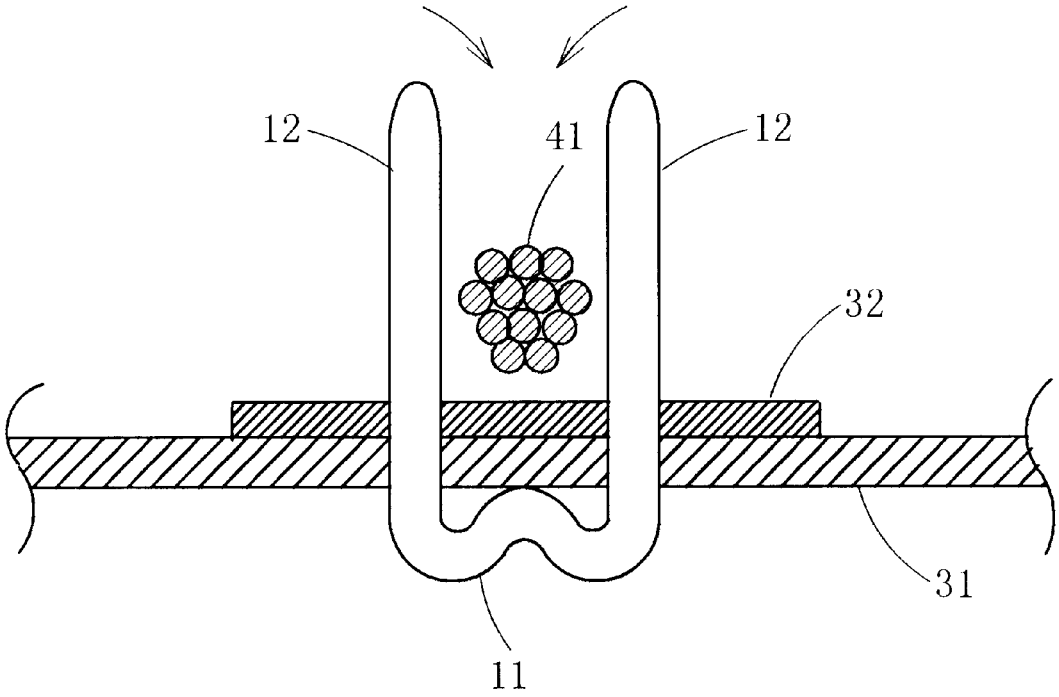
FIG. 3 is an end view showing fixing parts of the FPC crimp terminal of the first embodiment piercing an FPC from the back thereof.
Figure 4:
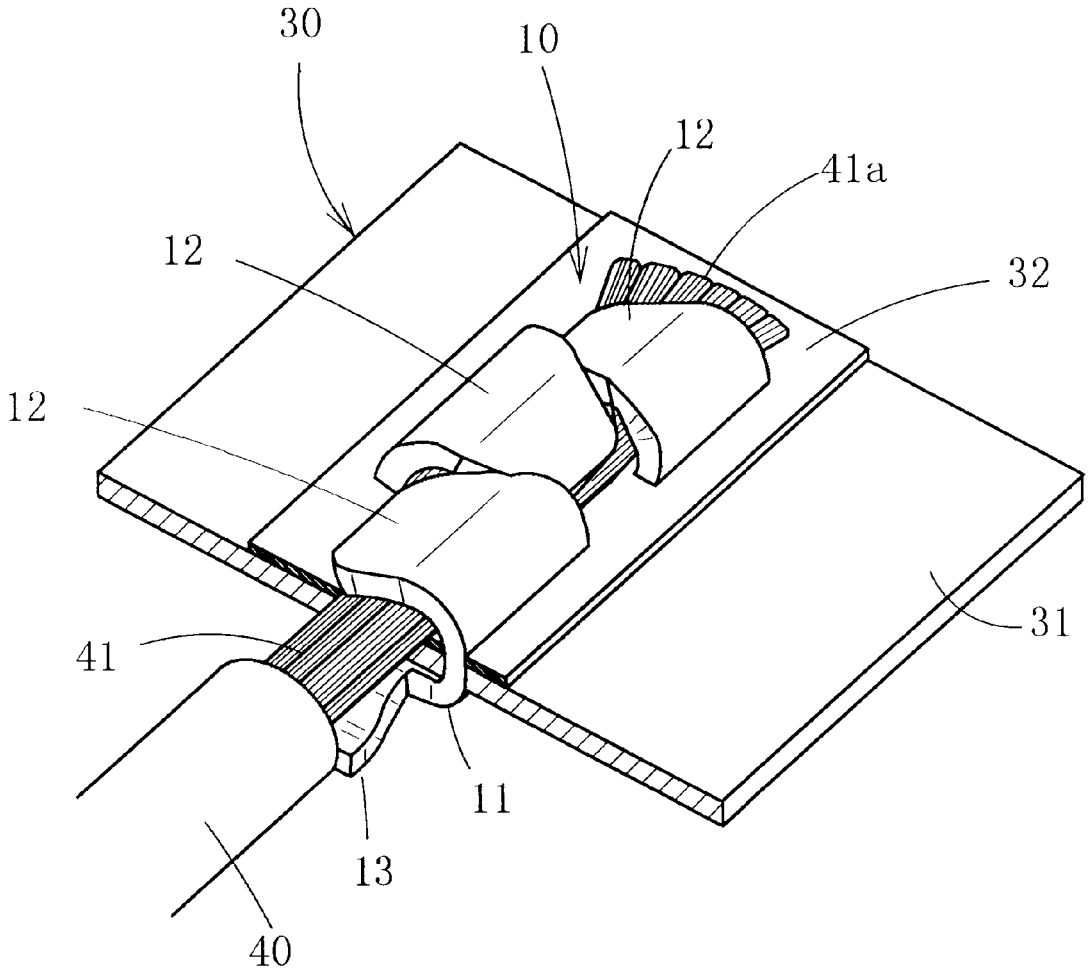
FIG. 4 is a perspective view in which the state of connection of a core to an FPC with the FPC crimp terminal of the first embodiment is shown by partially cutting away the FPC.
Figure 5:
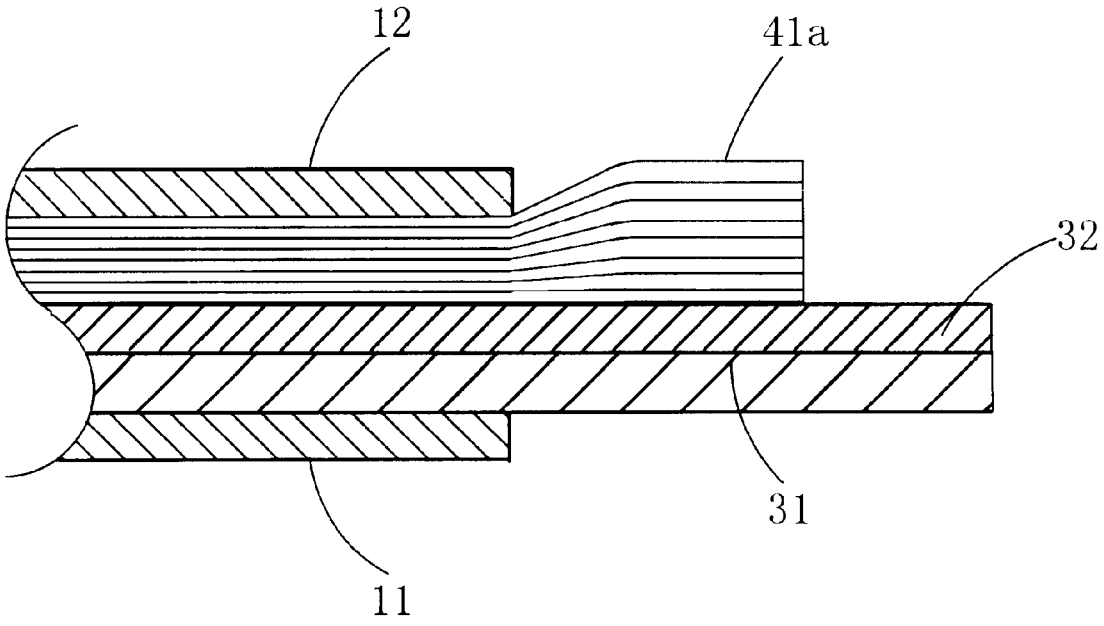
FIG. 5 is a longitudinal sectional view along a section that is parallel to the longitudinal direction of the core of FIG. 4.

Next, a method of use of the FPC crimp terminal 10 of the first embodiment will be described. As shown in FIG. 3, when a core 41 or a lead wire 51 is brought into direct contact with a conductor 32 of an FPC 30, fixing parts 12, 12, 12 rising from both edges in the width direction of the bottom plate are made to pierce the FPC 30 from its back so that the fixing parts 12, 12, 12 straddle the core 41 or the lead wire 51, and as shown in FIG. 4, the top ends of the fixing parts 12, 12, 12 coming out of the front of the FPC 30 are bent towards the bottom plate 11, the core 41 or the lead wire 51 will be pinched between the top ends of the fixing parts 12 and the bottom plate 11 and the core 41 or the lead wire 51 will be connected to the FPC 30. In the first embodiment, as shown by example in FIG. 5, the fixing part 12 crimps the core 41 with the top end 41*a* of the core 41 left uncrimped.

Figure 6:
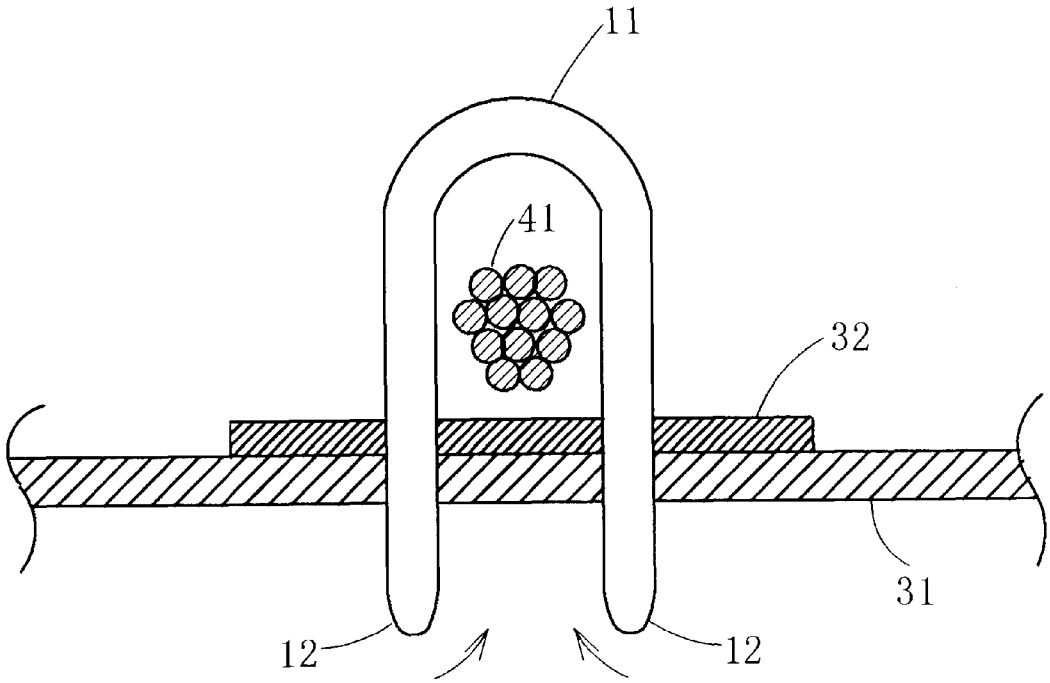
FIG. 6 is an end view that shows fixing parts of an FPC crimp terminal of a modification of the first embodiment being made to pierce from the front of the FPC.

Another method of use of the first embodiment is shown in FIG. 6. The FPC crimp terminal 10 shown in FIG. 6 has a form that is identical to that of the first embodiment except that the bottom plate 11 is bent into a U-letter shape in section matching to the sectional shape of the core 41 or the lead wire 51 so that the bottom plate 11 can be brought into direct contact with the core 41 or the lead wire 51. But, the shape of the bottom plate 11 is arbitrary for this method too. As shown in FIG. 6, when the core 41 or the lead wire 51 is brought into direct contact with a conductor 32 of an FPC 30, the fixing parts 12, 12, 12 rising from both ends in the width direction of the bottom plate are made to straddle the core 41 or the lead wire 51 and pierce the FPC 30 from the front, and the top ends of the fixing parts 12, 12, 12 coming out of the back of the FPC 30 are bent towards the bottom plate 11, the core 41 or the lead wire 51 and the FPC 30 will be pinched between the top ends of the fixing parts 12, 12, 12 and the bottom plate 11 and the core 41 or the lead wire 51 will be connected to the FPC 30.

Figure 2:
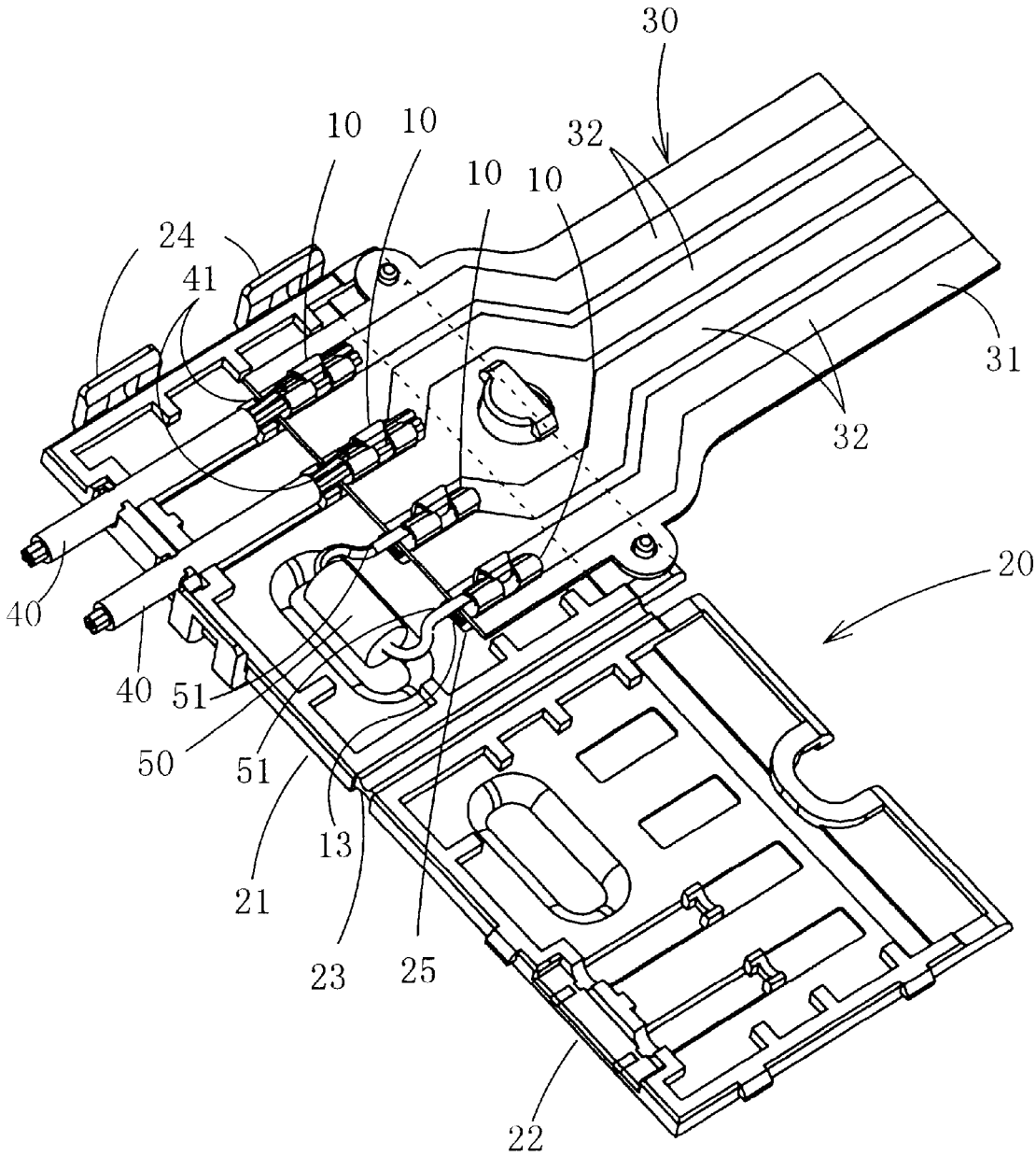
FIG. 2 is a perspective view in which FPC crimp terminals of the first embodiment are used to connect cores or lead wires to an FPC and the FPC crimp terminals are to be stored in the casing of a connector.

FIG. 2 shows a state in which the FPC 30, cores 41 and lead wires 51 being connected by the above-mentioned FPC crimp terminals 10 are to be stored in a casing 20 of a connector. The FPC 30 exemplified here has four conductors 32, and of these four conductors 32, two conductors are connected to cores 41 of electric wires 40 with FPC crimp terminals 10, and other two conductors are connected to lead wires 51 of an electrical component 50 with FPC crimp terminals 10. The casing 20 is made of resin, etc., and two shallow-box-shaped casing members 21, 22 are joined together on one side with a thin part 23. When the FPC 30, wires 40 and electrical component 50 being connected by FPC crimp terminals 10 are placed on one casing member 21, the other casing member 22 is folded and overlapped with the casing member 21 by deforming the thin part 23, and both the casing members 21, 22 are fixed to each other by locking members 24 that are formed on the sides opposite to the thin part 23, the FPC crimp terminals 10 will be stored in the casing 20. In this process, the stopper 13 protruding from each FPC crimp terminal 10 in the withdrawal direction of the core 41 or the lead wire 51 will be fit into and secured in a hole 25 that is formed in the inner wall of the casing member 21.

Accordingly, in the above-mentioned first embodiment, as fixing parts 12 are used to make piercing and crimping the core 41 or the lead wire 51 at the same time, there is no need of, in contrast with the related art, separately providing a connecting or splicing part. Thus the FPC crimp terminal 10 is shorter and more compact by that portion. Furthermore, as the piercing process and the connecting process are done simultaneously, the reduction in the number of processes improves the work efficiency. Moreover, as at least a pair of fixing parts 12, 12 rise from both edges in the width direction of the bottom plate 11, the pinching forces of the fixing parts 12 are stable and the crimping forces on the core 41 or the lead wire 51 are balanced well. The present invention includes embodiments in which the total number of fixing parts 12 is two and embodiments in which the total number of fixing parts 12 is four or over, and the spatial assignment of fixing parts 12 is not limited to both one edge and the other edge in width direction of the bottom plate 11. However, as is the case of the first embodiment, when the total number of fixing parts 12 is three and one fixing part is formed on one edge in width direction and two fixing parts are formed on the other edge, the consumption of the material for forming the fixing parts 12, 12, 12 can be reduced, and limited forces are required to pierce the fixing parts 12, 12, 12 and bend them. Thus this arrangement is advantageous in terms of cost.

The present invention includes embodiments in which the bottom plate 11 is not provided with a stopper 13. However, as is the case in the above-mentioned first embodiment, if a stopper 13 is formed on one end in the longitudinal direction of the bottom plate 11 to protrude in the withdrawal direction of the core 41 or the lead wire 51, when the FPC crimp terminal 10 being connected to a core 41 or a lead wire 51 is stored in a casing 20 of a connector, the stopper 13 will be held in the casing 20, and even if the core 41 or the lead wire 51 is pulled in the withdrawal direction, the FPC crimp terminal 10 will be hardly withdrawn from the casing 20.

The present invention includes embodiments in which the top end 41a of the core 41 is covered up by the bent fixing part 12. However, as is the case in the above-mentioned first embodiment, when a fixing part 12 crimps a core 41 with the top end 41*a* of the core 41 left uncrimped, the portion of the core 41 being crimped by the fixing part 12 will be compressed and a difference in grade will be made on the core 41 between the portion crimped by the fixing part 12 and the uncrimped top end 41*a*. This difference-in-grade portion is caught on an edge of the fixing part 12 and a retention force for the core 41 is provided. Accordingly, even if the core 41 is subjected to a pull, it will be hardly withdrawn.

Figure 7A:
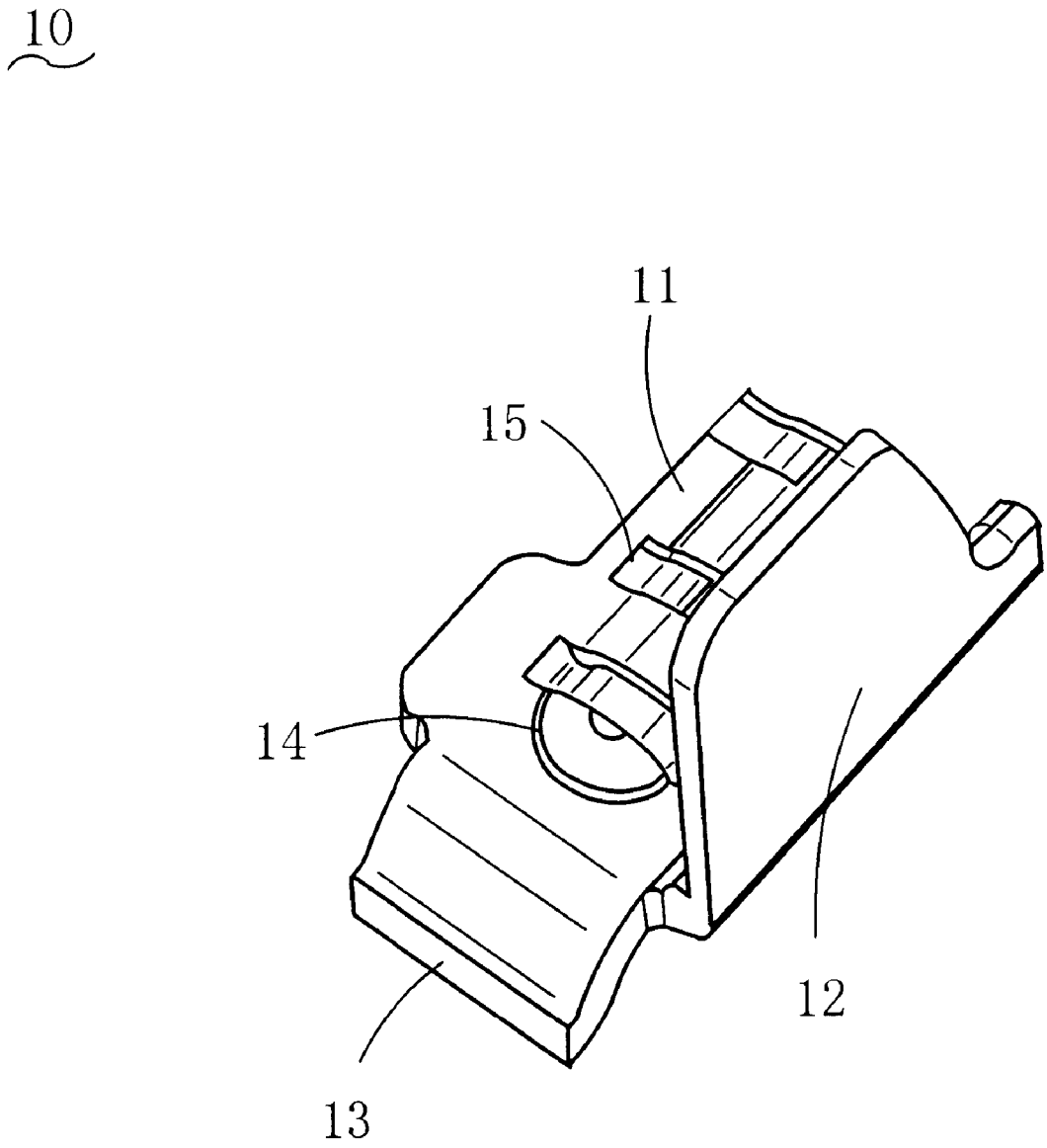
FIG. 7A is a perspective view showing an FPC crimp terminal of the send embodiment.

FIG. 7A shows the second embodiment. In the second embodiment, one fixing part 12 is provided. Thus this FPC crimp terminal 10 comprises a bottom plate 11 formed from a flat plate and one fixing part 12 that rises from one edge of the bottom plate 11. This FPC crimp terminal 10 is formed in such a way that when a core 41 or a lead wire 51 is brought into direct contact with a conductor 32 of an FPC 30, the fixing part 12 is made to pierce the FPC 30, and the top end of the fixing part 12 coming out of the FPC 30 is bent towards the bottom plate 11, the core 41 or the lead wire 51 will be pinched between the top end of the fixing part 12 and the bottom plate 11. The height of the fixing part 12 rising from the bottom plate 11 is set greater than at least the sum of the thickness of the FPC 30 and the outside diameter of the core 41 or the lead wire 51. If the height of the fixing part 12 rising from the bottom plate 11 is increased more, the core 41 or the lead wire 51 can be reliably pinched against the FPC 30 with a higher surface pressure, and this is preferable. A stopper 13 is formed on one end in the longitudinal direction of the bottom plate 11 of the above-mentioned FPC crimp terminal 10 to protrude in the withdrawal direction of the core 41 or the lead wire 51. This stopper 13 is formed, when necessary, to slant a little in the direction opposite to the direction the fixing part 12 rises from the bottom plate 11. This FPC crimp terminal 10 is formed from a single plate. For example, it is formed by blanking out a blank from a plate and bending the fixing part 12 in relation to the bottom plate 11. In this sequence of processes, when necessary, a dimple 14 and beads 15 are formed and the stopper 13 is bent in relation to the bottom plate 11.

Figure 7B:
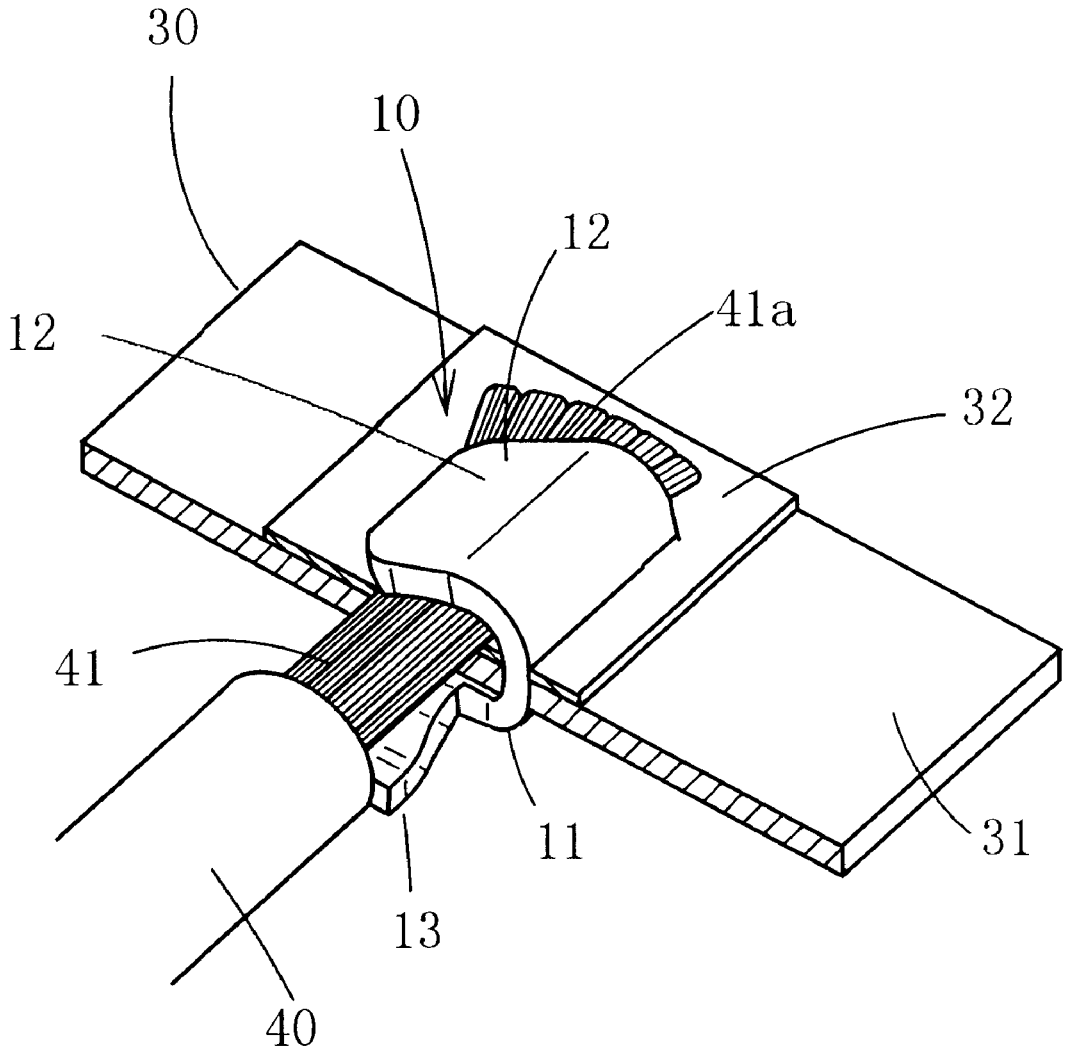
FIG. 7B is a perspective view in which the state of connection of a core an FPC with the FPC crimp terminal of the second embodiment is shown by partially cutting away the FPC.
Figure 8:
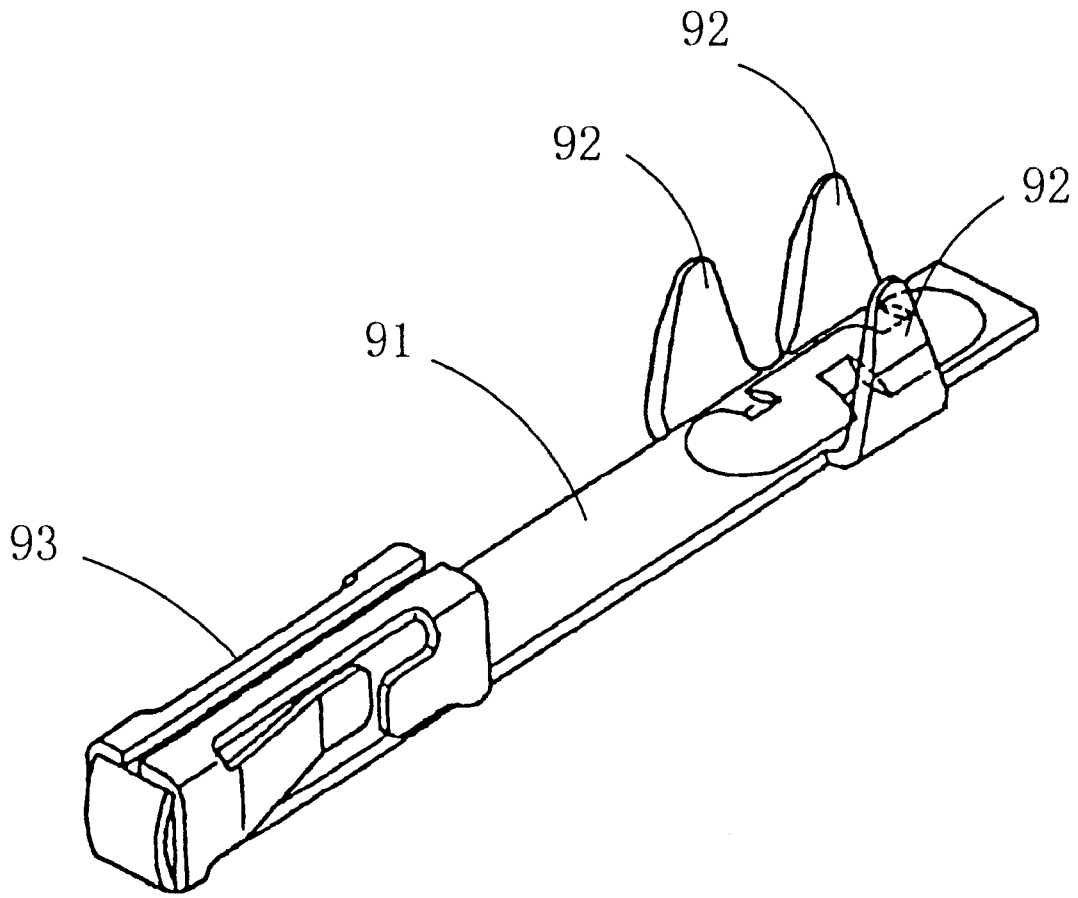
FIG. 8 is a perspective view showing a related art.

Next, a method of use of the FPC crimp terminal 10 of the second embodiment will be described in referring to FIG. 7B. When a core 41 or a lead wire 51 is brought into direct contact with a conductor 32 of an FPC 30, the fixing part 12 is made to pierce the FPC 30, and the top end of the fixing part 12 coming out of the FPC 30 is bent towards the bottom plate 11, the core 41 or the lead wire 51 will be pinched between the top end of the fixing part 12 and the bottom plate 11 and the core 41 or the lead wire 51 will be connected to the FPC 30. In this case, the fixing part 12 may be made to pierce the FPC 30 from the back, then the top end of the fixing part 12 coming out of the front of the FPC 30 may be bent towards the bottom plate 11, or the fixing part 12 may be made to pierce the FPC 30 from the front, then the top end of the fixing part 12 coming out of the back of the FPC 30 may be bent towards the bottom plate 11. In this second embodiment, the fixing part 12 crimps the core with the top end 41*a* of the core 41 being left uncrimped.

Accordingly, in the above-mentioned second embodiment, as the fixing part 12 is used to make piercing and crimping the core 41 or the lead wire 51 at the same time, there is no need of, in contrast with the related art, separately providing a connecting or splicing part. Thus the FPC crimp terminal 10 is shorter and more compact by that portion. Furthermore, as piercing process and the connecting process are done simultaneously, the reduction in the number of processes improves the work efficiency. The present invention includes embodiments in which a plurality of fixing parts 12 are provided in the longitudinal direction of the bottom plate 11 in the second embodiment.

The present invention includes embodiments in which the bottom plate 11 is not provided with a stopper 13. However, as is the case in the second embodiment, if a stopper 13 is formed on one end in the longitudinal direction of the bottom plate 11 to protrude in the withdrawal direction of the core 41 or the lead wire 51, when the FPC crimp terminal 10 being connected to the core 41 or the lead wire 51 is stored in a casing 20 of a connector, the stopper 13 will be held in the casing 20, and even if the core 41 or the lead wire 51 is pulled in the withdrawal direction, the FPC crimp terminal 10 will be hardly withdrawn from the casing 20.

The present invention includes embodiments in which the top end 41*a* of the core 41 is covered up by the bent fixing part 12. However, as is the case in the above-mentioned second embodiment, when a fixing part 12 crimps a core 41 with the top end 41*a* of the core 41 left uncrimped, the portion of the core 41 being crimped by the fixing part 12 will be compressed and a difference in grade will be made on the core 41 between the portion crimped by the fixing part 12 and the uncrimped top end 41*a*. This difference-in-grade portion is caught on an edge of the fixing part 12 and a retention force for the core 41 is provided. Accordingly, even if the core 41 is subjected to a pull, it will be hardly withdrawn.

The present invention is not limited to the respective above-mentioned embodiments. In each of the above-mentioned embodiments, the fixing part 12 is made to penetrate through the conductor 32, but the present invention includes embodiments in which the fixing part 12 is made to penetrate only through the thin plate or film 31 of the FPC 30. In such embodiments, the FPC crimp terminal 10 is formed in such a way that when a core 41 or a lead wire 51 is brought into direct contact with a conductor 32 of an FPC 30, and in piercing the FPC 30 with fixing parts 12 or a fixing part 12, fixing parts 12 or a fixing part 12 are made to pierce not the conductor 12 but the thin plate or film 31 only, and the top ends of the fixing parts 12 or the top end of the fixing part 12 coming out of the FPC 30 are bent towards the bottom plate 11, the core 41 or the lead wire 51 and the FPC will be pinched between the top ends of the fixing parts 12 or the top end of the fixing part 12 and the bottom plate 11. Furthermore, in the above-mentioned embodiment, the FPC 30, core 41 and lead wire 51 being connected by FPC crimp terminals 10 are stored in the casing 20 of the connector, but the form of assembling such parts into a casing is not limited to it. The present invention includes embodiments in which such components are not stored in a casing. Moreover, the present invention includes embodiments in which the number of conductors 32 fixed on one FPC 30 is varied, embodiments in which the number of FPC crimp terminals 10 used is varied, embodiments in which connection is limited to cores 41 only, and embodiments in which connection is limited to lead wires 51 only. Further, the present invention includes embodiments in which the above-mentioned embodiments are combined in various ways.

What is claimed is:

1. An FPC crimp terminal comprising: a body having a bottom plate and a single fixing part rising from an edge of the bottom plate such that when a core or a lead wire is brought into direct contact with a conductor of an FPC, the fixing part pierces the FPC from at least one of a back or front surface of the FPC so that a top end of the fixing part extends out of the FPC and is bent towards the bottom plate, and the core or the lead wire and the FPC are pinched between a top end of the fixing part and the bottom plate, wherein said fixing part substantially simultaneously pierces the FPC and connects the core or lead wire to the conductor of the EPC.

2. An FPC crimp terminal of claim 1 wherein the height of the fixing part rising from the bottom plate is set greater than at least the sum of the thickness of the FPC and the outside diameter of the core or the lead wire.

3. An FPC crimp terminal comprising: a body having a rectangular bottom plate and fixing parts rising from both edges in the width direction of the bottom plate such that when a core or a lead wire is brought into direct contact with a conductor of an FPC, the fixing parts straddle the core or the lead wire and pierce the FPC from at least one of a back or front surface of the FPC so that respective top ends of the fixing parts extend out of the FPC and are bent towards the bottom plate, and the core or the lead wire and the FPC are pinched between the top ends of the fixing parts and the bottom plate, wherein said fixing part substantially simultaneously pierces the FPC and connects the core or lead wire to the conductor of the FPC.

4. An FPC crimp terminal of claim 3 wherein the bottom plate has a width that is substantially identical to the outside diameter of the core or the lead wire and the height of the fixing parts rising from the bottom plate is set greater than at least the sum of the thickness of the FPC and the outside diameter of the core or the lead wire.

5. An FPC crimp terminal of claim 1 wherein a stopper is formed on one end in the longitudinal direction of the bottom plate to protrude in the withdrawal direction of the core or the lead wire.

6. An FPC crimp terminal of claim 2 wherein a stopper is formed on one end in the longitudinal direction of the bottom plate to protrude in the withdrawal direction of the core or the lead wire.

7. An FPC crimp terminal of claim 3 wherein a stopper is formed on one end in the longitudinal direction of the bottom plate to protrude in the withdrawal direction of the core or the lead wire.

8. An FPC crimp terminal of claim 4 wherein a stopper is formed on one end in the longitudinal direction of the bottom plate to protrude in the withdrawal direction of the core or the lead wire.

9. A crimp structure for connecting a core to an FPC with the FPC crimp terminal of claim 1 wherein a core is brought into direct contact with a conductor of an FPC, a fixing part or fixing parts is made to pierce the FPC from its back or front, the top end of the fixing part or the top ends of the fixing parts coming out of the FPC is bent towards the bottom plate, the core and the FPC are pinched between the top end of the fixing part or the top ends of the fixing parts and the bottom plate, and the fixing part or the fixing parts crimps the core with the top end of the core left uncrimped.

10. A crimp structure for connecting a core to an FPC with the FPC crimp terminal of claim 2 wherein a core is brought into direct contact with a conductor of an FPC, a fixing part or fixing parts is made to pierce the FPC from its back or front, the top end of the fixing part or the top ends of the fixing parts coming out of the FPC is bent towards the bottom plate, the core and the FPC are pinched between the top end of the fixing part or the top ends of the fixing parts and the bottom plate, and the fixing part or the fixing parts crimps the core with the top end of the core left uncrimped.

11. A crimp structure for connecting a core to an FPC with the FPC crimp terminal of claim 3 wherein a core is brought into direct contact with a conductor of an FPC, a fixing part or fixing parts is made to pierce the FPC from its back or front, the top end of the fixing part or the top ends of the fixing parts coming out of the FPC is bent towards the bottom plate, the core and the FPC are pinched between the top end of the fixing part or the top ends of the fixing parts and the bottom plate, and the fixing part or the fixing parts crimps the core with the top end of the core left uncrimped.

12. A crimp structure for connecting a core to an FPC with the FPC crimp terminal of claim 4 wherein a core is brought into direct contact with a conductor of an FPC, a fixing part or fixing parts is made to pierce the FPC from its back or front, the top end of the fixing part or the top ends of the fixing parts coming out of the FPC is bent towards the bottom plate, the core and the FPC are pinched between the top end of the fixing part or the top ends of the fixing parts and the bottom plate, and the fixing part or the fixing parts crimps the core with the top end of the core left uncrimped.

13. A crimp structure for connecting a core to an FPC with the FPC crimp terminal of claim 5 wherein a core is brought into direct contact with a conductor of an FPC, a fixing part or fixing parts is made to pierce the FPC from its back or front, the top end of the fixing part or the top ends of the fixing parts coming out of the FPC is bent towards the bottom plate, the core and the FPC are pinched between the top end of the fixing part or the top ends of the fixing parts and the bottom plate, and the fixing part or the fixing parts crimps the core with the top end of the core left uncrimped.

14. A crimp structure for connecting a core to an FPC with the FPC crimp terminal of claim 6 wherein a core is brought into direct contact with a conductor of an FPC, a fixing part or fixing parts is made to pierce the FPC from its back or front, the top end of the fixing part or the top ends of the fixing parts coming out of the FPC is bent towards the bottom plate, the core and the FPC are pinched between the top end of the fixing part or the top ends of the fixing parts and the bottom plate, and the fixing part or the fixing parts crimps the core with the top end of the core left uncrimped.

15. A crimp structure for connecting a core to an FPC with the FPC crimp terminal of claim 7 wherein a core is brought into direct contact with a conductor of an FPC, a fixing part or fixing parts is made to pierce the FPC from its back or front, the top end of the fixing part or the top ends of the fixing parts coming out of the FPC is bent towards the bottom plate, the core and the FPC are pinched between the top end of the fixing part or the top ends of the fixing parts and the bottom plate, and the fixing part or the fixing parts crimps the core with the top end of the core left uncrimped.

16. A crimp structure for connecting a core to an FPC with the FPC crimp terminal of claim 8 wherein a core is brought into direct contact with a conductor of an FPC, a fixing part or fixing parts is made to pierce the FPC from its back or front, the top end of the fixing part or the top ends of the fixing parts coming out of the FPC is bent towards the bottom plate, the core and the FPC are pinched between the top end of the fixing part or the top ends of the fixing parts and the bottom plate, and the fixing part or the fixing parts crimps the core with the top end of the core left uncrimped.

* * * * *